US005359394A

United States Patent [19]

Ogawa et al.

[11] Patent Number: 5,359,394

[45] Date of Patent: Oct. 25, 1994

[54] FOREIGN MATTER REMOVING MECHANISM FOR ELECTROPHOTOGRAPHIC PRINTER

[75] Inventors: Hiroyuki Ogawa; Kuraichi Fukaya; Takao Chikuzenya; Shuuho Yokokawa, all of Ibaraki, Japan

[73] Assignee: Hitachi Koki Co., Ltd., Tokyo, Japan

[21] Appl. No.: 44,455

[22] Filed: Apr. 9, 1993

[30] Foreign Application Priority Data

Apr. 30, 1992 [JP] Japan ..... 4-111145

[51] Int. Cl.[5] ..... G03G 21/00

[52] U.S. Cl. ..... 355/215; 15/256.5; 355/296

[58] Field of Search ..... 15/256.5, 256.51; 355/296, 297, 301, 302, 215

[56] References Cited

U.S. PATENT DOCUMENTS 4,862,221 8/1989 Tabuchi et al. ..... 15/256.5
4,878,657 11/1989 Ura et al. ..... 355/215 X
5,132,731 7/1992 Oda ..... 355/215

*Primary Examiner*—A. T. Grimley
*Assistant Examiner*—Nestor R. Ramirez
*Attorney, Agent, or Firm*—Sughrue, Mion, Zinn, Macpeak & Seas

[57] ABSTRACT

A foreign matter removing mechanism for an electrophotographic printer, which includes: a sheet guide 2a, arranged between a photosensitive drum 1 and a tractor 9, for guiding a print sheet 3; and a foreign matter removing member 5 arranged so as to confront the sheet guide 2a through a predetermined gap 4 relative to the sheet guide 2a. In the foreign matter removing mechanism, a notch 11 is arranged on at least one confronting surface of the sheet guide 2a and the foreign matter removing member 5.

2 Claims, 2 Drawing Sheets

FOREIGN MATTER REMOVING MECHANISM FOR ELECTROPHOTOGRAPHIC PRINTER

BACKGROUND OF THE INVENTION

1. Field of the Invention

The invention relates to a mechanism for removing foreign matter for use in an electrophotographic printer.

2. Description of Related Art

FIG. 1 shows a conventional example of a foreign matter removing mechanism for an electrophotographic printer. As shown in FIG. 1, the foreign matter removing mechanism includes: a sheet guide 2 which is arranged in front of a photosensitive drum 1 in a sheet forward section and which has a smooth curved surface; and a foreign matter removing member 5 which confronts the sheet guide 2 and which defines such a narrow gap 4 as to allow a print sheet 3 to pass therethrough smoothly relative to the confronting surface.

As the print sheet 3 passes through the narrow gap 4 during printing, foreign matter 6 present on the print sheet 3 is dropped off by this narrow gap 4, thereby keeping the photosensitive drum 1 undamaged. In FIG. 1, reference numeral 7 designates a frame; 8, a retractor blade; 9, a tractor; and 10, a gap defined between the photosensitive drum 1 and the retractor blade 8.

In the conventional foreign matter removing mechanism including the sheet guide 2 and the foreign matter removing member 5, the confronting surfaces are designed to be curved. This allows the foreign matter 6 to pass therebetween without much resistance and, as a result, the foreign matter 6 loosely present or firmly stuck on the print sheet 3 cannot be removed sufficiently, damaging the photosensitive drum surface in some cases.

SUMMARY OF THE INVENTION

The invention has been made in view of the above circumstances. Accordingly, an object of the invention is to provide a foreign matter removing mechanism for an electrophotographic printer capable of preventing the photosensitive drum surface from being damaged.

The above object can be achieved by providing a notch on the confronting surface of either a sheet guide or a foreign matter removing member, both confronting each other.

The above-described mechanism equipped with a notch either drops the foreign matter loosely or firmly stuck on the print sheet stops movement of the sheet at the position at which the foreign matter stays.

DETAILED DESCRIPTION OF THE PREFERRED EMBODIMENTS

An embodiment of the invention will now be described in more detail.

Figure 1:
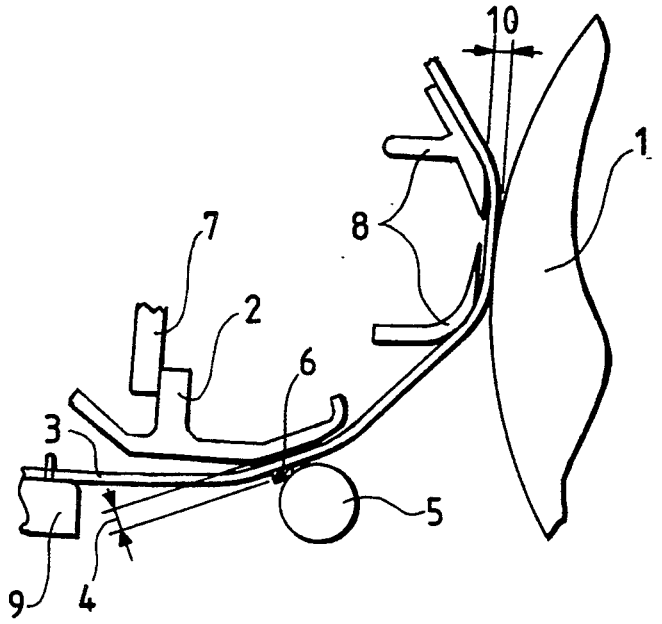
FIG. 1 PRIOR ART
FIG. 1 is a side view showing a conventional foreign matter removing mechanism for an electrophotographic printer.
Figure 2:
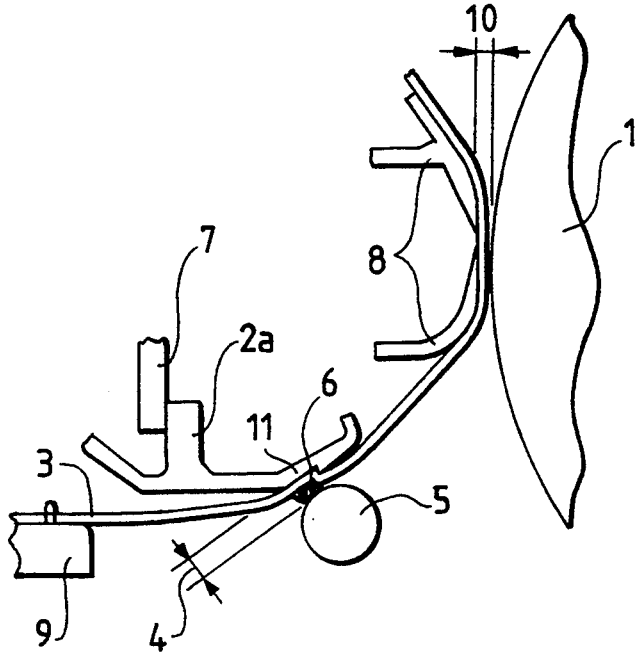
FIG. 2 is a side view of a foreign matter removing mechanism for an electrophotographic printer, which is an embodiment of the invention.

FIG. 2 shows an embodiment of the invention. Since the same parts and components as those of the conventional example are designated as the same reference numerals, the description of these parts and components will be omitted. In this embodiment, a notch 11 is arranged on at least one confronting surface of either a sheet guide 2*a* or a foreign matter removing member 5, which confront each other. This arrangement can implement a foreign matter removing mechanism for an electrophotographic printer which is capable of preventing a photosensitive drum 1 from being damaged while either dropping off the foreign matter 6 loosely or firmly stuck on a print sheet 3 or stop movement of the sheet 3 at the position at which the foreign matter 6 is present by the notch 11.

That is, the notch 11 is arranged at a position confronting the foreign matter removing member 5 on the sheet forward surface of the sheet guide 2*a*. This arrangement allows the print sheet 3 to pass through the gap 4 during printing, causes the image to be transferred thereon upon arrival at the gap 10, whereas either the print sheet 3 having the foreign matter 6 loosely or firmly stuck thereon drops off the foreign matter 6 between the notch 11 of the sheet guide 2*a* and the foreign mater removing member 5, or the foreign matter 6 is presented from further movement together with part of the sheet 3. Thus, the problem of damaging the surface of the photosensitive drum 1 is overcome.

Figure 3:
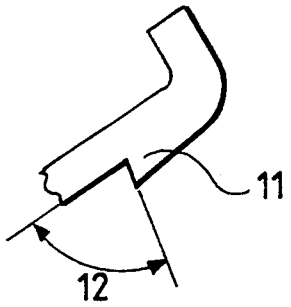
FIG. 3 is an enlarged view of an exemplary notch.

In this case, the notching angle 12 of the sheet guide 2*a* is set to a value smaller than 130 degrees relative to a tangent formed by the foreign matter removing member 5 that confronts the notch, so that foreign matter on thin paper and the foreign matter 6 firmly stuck on the sheet 3 can be removed (see FIG. 3).

As described above, the embodiment is characterized as having a notch on at least the sheet guide or the foreign matter removing member, so that the function of removing the foreign matter stuck on the print sheet can be improved. In the case where foreign matter is firmly stuck on a print sheet, the sheet can be cut off by the foreign matter removing mechanism.

Figure 4:
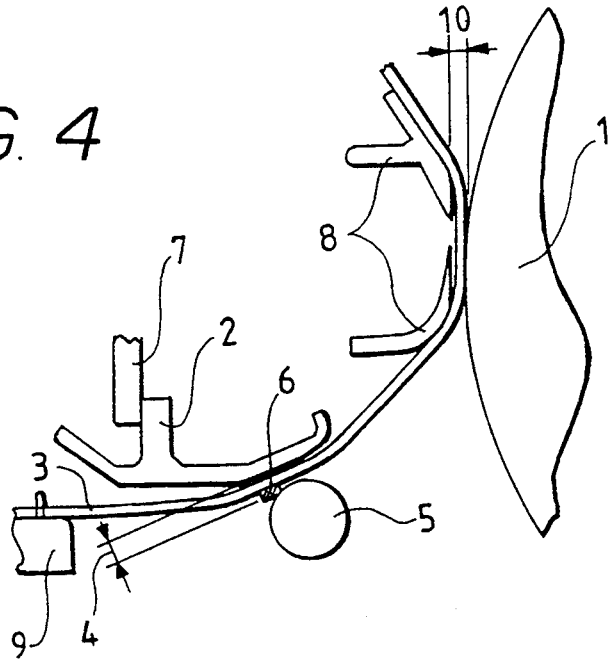
FIG. 4 illustrates a modification of the preferred embodiment.

While the example in which the notch is arranged on the sheet guide has been described in this embodiment, it goes without saying that a similar advantage can be provided by providing the notch on the foreign matter removing member, as illustrated in FIG. 4.

As described in the foreign pages, the invention is characterized as having a notch on at least the sheet guide or the foreign matter removing member, which confront each other. The notch allows either foreign matter loosely or firmly stuck on the sheet to be dropped off, or the sheet to be cut off at the position at which the foreign matter is present. As a result, a foreign matter removing mechanism for an electrophotographic printer which is capable of preventing the photosensitive drum surface from being damaged can be obtained.

What is claimed is:

1. A foreign matter removing mechanism for an electrophotographic printer, comprising:

a sheet guide arranged between a photosensitive drum and a tractor, for guiding a print sheet, said sheet guide having a first surface on which the print sheet is guided; and a foreign matter removing member arranged to confront said sheet guide and to define a predetermined gap in cooperation with said sheet guide, said foreign matter removing member having a second surface which opposes said first surface;

wherein a recess is formed in at least one of said first and second surfaces.

2. A foreign matter removing mechanism as claimed in claim 1, wherein said recess is defined by at least one side wall which defines an angle of 130 degrees or smaller relative to a tangent of said first surface when said recess is formed in said sheet guide and defines an angle of 130 degrees or smaller relative to a tangent line of said second surface when said recess is formed in said foreign matter removing member.

* * * * *